US007682207B2

(12) United States Patent
Clark

(10) Patent No.: US 7,682,207 B2
(45) Date of Patent: Mar. 23, 2010

(54) CARRIER STRIP FOR ELECTRICAL CONTACTS

(75) Inventor: Stephen H. Clark, New Lenox, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/417,188

(22) Filed: Apr. 2, 2009

(65) Prior Publication Data

US 2010/0022143 A1 Jan. 28, 2010

Related U.S. Application Data

(60) Provisional application No. 61/083,303, filed on Jul. 24, 2008.

(51) Int. Cl.
*H01R 9/24* (2006.01)

(52) U.S. Cl. ..... 439/885

(58) Field of Classification Search ..... 439/885
See application file for complete search history.

(56) References Cited

U.S. PATENT DOCUMENTS 2,225,739 A * 12/1940 Elliott ..... 29/33.5
4,616,416 A * 10/1986 Cabaud ..... 29/884
4,681,391 A * 7/1987 Bouley ..... 439/444
4,749,368 A * 6/1988 Mouissie ..... 439/421
4,865,562 A * 9/1989 Burg et al. ..... 439/395
4,979,903 A * 12/1990 Gosselin ..... 439/78
5,046,965 A * 9/1991 Neese et al. ..... 439/372
5,060,372 A * 10/1991 Capp et al. ..... 29/883
5,632,629 A * 5/1997 Legrady ..... 439/78
5,848,920 A * 12/1998 Klein et al. ..... 439/885
5,860,821 A * 1/1999 Pernet ..... 439/188
5,867,895 A * 2/1999 Van Beneden et al. ..... 29/827
5,938,039 A 8/1999 Liu ..... 206/717
6,186,843 B1 * 2/2001 Chen et al. ..... 439/885
6,238,245 B1 * 5/2001 Stokoe et al. ..... 439/607.07
6,241,564 B1 * 6/2001 Chen et al. ..... 439/885
6,264,511 B1 * 7/2001 Bu ..... 439/885
6,290,550 B1 * 9/2001 Lomastro et al. ..... 439/723
6,295,726 B1 * 10/2001 Maatta ..... 29/827
6,524,129 B2 * 2/2003 Cote et al. ..... 439/511
6,637,106 B2 * 10/2003 Sato et al. ..... 29/878
6,679,734 B2 * 1/2004 Lomastro et al. ..... 439/723
6,695,625 B1 * 2/2004 Ma et al. ..... 439/70
6,712,650 B1 * 3/2004 Cheng ..... 439/891
6,772,516 B2 * 8/2004 Lomastro et al. ..... 29/876
6,827,615 B2 * 12/2004 Axelsson ..... 439/885
6,857,916 B1 * 2/2005 Huang ..... 439/885

(Continued)

*Primary Examiner*—T C Patel
*Assistant Examiner*—Vladimir Imas
(74) *Attorney, Agent, or Firm*—Mark W. Croll; Paul F. Donovan

(57) ABSTRACT

An electrical contact carrier strip includes a main body, a plurality of electrical contacts integrally formed with and connected to the main body, and a plurality of support tabs extending from the main body. Each of the support tabs includes a stem connected to the main body and a free expanded base that is aligned with and wider than the stem. The support tabs provide a clearance gap in which at least portions of the plurality of electrical contacts reside. The plurality of support tabs support the portions of the plurality of electrical contacts over a plane in which distal ends of each of the free expanded bases of the support tabs reside.

20 Claims, 3 Drawing Sheets

U.S. PATENT DOCUMENTS

| | | | | |
|---|---|---|---|---|
| 6,863,578 | B2 * | 3/2005 | Templin et al. | 439/876 |
| 6,951,477 | B2 * | 10/2005 | Tondreault et al. | 439/497 |
| 2002/0182945 | A1 * | 12/2002 | Axelsson | 439/885 |
| 2004/0072477 | A1 * | 4/2004 | Templin et al. | 439/876 |
| 2004/0077190 | A1 * | 4/2004 | Huang et al. | 439/66 |
| 2004/0087196 | A1 * | 5/2004 | Lang et al. | 439/181 |
| 2004/0127078 | A1 * | 7/2004 | Tondreault et al. | 439/98 |
| 2004/0235323 | A1 * | 11/2004 | Ferry et al. | 439/95 |
| 2005/0009385 | A1 * | 1/2005 | Korsunsky et al. | 439/83 |
| 2005/0118846 | A1 * | 6/2005 | Clark et al. | 439/108 |
| 2005/0176307 | A1 * | 8/2005 | Lang et al. | 439/676 |
| 2005/0181677 | A1 * | 8/2005 | Lang et al. | 439/676 |
| 2005/0287831 | A1 * | 12/2005 | Mongold et al. | 439/66 |
| 2005/0287832 | A1 * | 12/2005 | Mongold et al. | 439/66 |
| 2005/0287844 | A1 * | 12/2005 | Mongold et al. | 439/83 |
| 2005/0287845 | A1 * | 12/2005 | Mongold et al. | 439/83 |
| 2005/0287879 | A1 * | 12/2005 | Mongold et al. | 439/874 |
| 2006/0068635 | A1 * | 3/2006 | Lemke et al. | 439/582 |
| 2006/0166536 | A1 * | 7/2006 | Northey et al. | 439/188 |
| 2006/0194481 | A1 * | 8/2006 | Clark et al. | 439/825 |
| 2006/0246758 | A1 * | 11/2006 | Sinclair | 439/259 |
| 2007/0042619 | A1 * | 2/2007 | Ferry et al. | 439/108 |
| 2007/0087592 | A1 * | 4/2007 | Thomson et al. | 439/78 |
| 2007/0155255 | A1 * | 7/2007 | Galauner et al. | 439/891 |
| 2008/0064264 | A1 * | 3/2008 | Clark et al. | 439/626 |
| 2008/0132093 | A1 * | 6/2008 | Jordan et al. | 439/67 |

* cited by examiner

CARRIER STRIP FOR ELECTRICAL CONTACTS

RELATED APPLICATIONS

This application relates to and claims priority benefits from U.S. Provisional Patent Application No. 61/083,303 entitled "System and Method of Reel-To-Reel Stamping of Formed Electrical Contacts," filed Jul. 24, 2008, which is hereby incorporated by reference in its entirety.

FIELD OF EMBODIMENTS OF THE INVENTION

Embodiments of the present invention generally relate to a system and method of forming electrical contacts, and more particularly, to a system and method of reel-to-reel stamping of formed electrical contacts.

BACKGROUND

Electrical contacts are typically small and fragile. When stamped off a die as individual parts, or bulk packaged, they are easily damaged via normal handling. For example, a fragile electrical lead at a distal end of an electrical contact may be easily snapped or bent if handled without due care.

In order to reduce the susceptibility of damaging individually stamped parts, a plurality of electrical contacts are often stamped and connected to a carrier strip. After the stamping process, the electrical contacts and the associated carrier strip are spooled onto a cardboard or plastic reel.

After the stamping process, electrical contacts are often plated with metals that increase conductivity and minimize or prevent corrosion. For example, the contacts may be plated with tin, gold or palladium. Portions of the contacts that are individually stamped are generally bulk or barrel plated. As such, the thickness of the plating material on the electrical contact is typically uniform.

If the electrical contacts are stamped with an associated carrier strip and positioned on a reel, however, the plating material may be selectively applied on functional areas of the contacts, thereby reducing the amount of plating material used. Consequently, manufacturing costs are reduced.

Electrical contacts typically remain connected to a carrier strip and reel until they are ready to be assembled into a housing. Because the contacts are secured to a continuous strip at known distances from one another, automated processes may be employed to remove the electrical contacts from the carrier strip.

Many electrical contacts include bent or angled portions. For example, a distal end of an electrical contact may be bent out of plane from the base depending on various applications. Such out-of-plane electrical contacts are not amenable to being reeled because one layer of contacts would interfere with and damage another layer of contacts positioned above or below the layer. Consequently, a manufacturer is unable to take advantage of the plating and handling advantages of a reeled strip of electrical contacts.

SUMMARY OF EMBODIMENTS OF THE INVENTION

Certain embodiments of the present invention provide an electrical contact carrier strip that includes a main body, a plurality of electrical contacts integrally formed with and connected to the main body, and a plurality of sets of support tabs extending from the main body. Each of the electrical contacts includes at least a portion that is out of plane with respect to the main body. Each of the support tabs is perpendicular to the main body and includes a stem connected to the main body and a free expanded base that is aligned with and wider than the stem. The sets of support tabs provide a clearance gap in which the portions of the plurality of electrical contacts that are out of plane with respect to the main body reside. The sets of support tabs prevent the portions of the plurality of electrical contacts that are out of plane with respect to the main body from intersecting a plane containing a surface over which the plurality of sets of support tabs support the main body.

The main body is flexible and may be spooled around a reel such that a first portion of the main body overlaps a second portion of the main body. The plurality of sets of support tabs support the first portion of the main body over the second portion of the main body.

Each of the plurality of sets of support tabs may include a pair of support tabs that are symmetrically aligned with respect to a longitudinal axis of the main body. Each support tab may be shaped as a trapezoid.

The main body may include at least one connecting strap parallel with a longitudinal axis of the main body. Each of the plurality of electrical contacts may be integrally attached to the at least one connecting strap.

Each of the support tabs may be formed by cutting three sides within the main body and pivoting the expanded base away from the main body about the stem that remains attached to the main body.

Certain embodiments of the present invention provide an electrical contact carrying system that includes a reel, a main planar body, a plurality of electrical contacts integrally formed with and connected to the main body, and a plurality of sets of support tabs extending from the main planar body. Each of the electrical contacts may include at least a portion that is out of plane with respect to the main planar body. Each of the support tabs is perpendicular to the main planar body and includes a stem connected to the main planar body and a free expanded base that is aligned with and wider than the stem. The sets of support tabs provide a clearance gap in which the portions of the plurality of electrical contacts that are out of plane with respect to the main body reside. The main body is spooled around the reel such that a first portion of the main body overlaps a second portion of the main body. The plurality of sets of opposed support tabs support the first portion of the main body over the second portion of the main body. The plurality of sets of support tabs prevent the portions of the plurality of electrical contacts that are out of plane with respect to the main planar body from intersecting a plane of a surface over which the plurality of sets of support tabs support the main planar body.

Certain embodiments of the present invention provide an electrical contact carrier strip that includes a main body, a plurality of electrical contacts integrally formed with and connected to the main body, and a plurality of support tabs extending from the main body. Each of the support tabs includes a stem connected to the main body and a free expanded base that is aligned with and wider than the stem. The support tabs provide a clearance gap in which at least portions of the plurality of electrical contacts reside. The plurality of support tabs support the at least portions of the plurality of electrical contacts over a plane in which distal ends of each of the free expanded bases of the support tabs reside.

Figure 1:
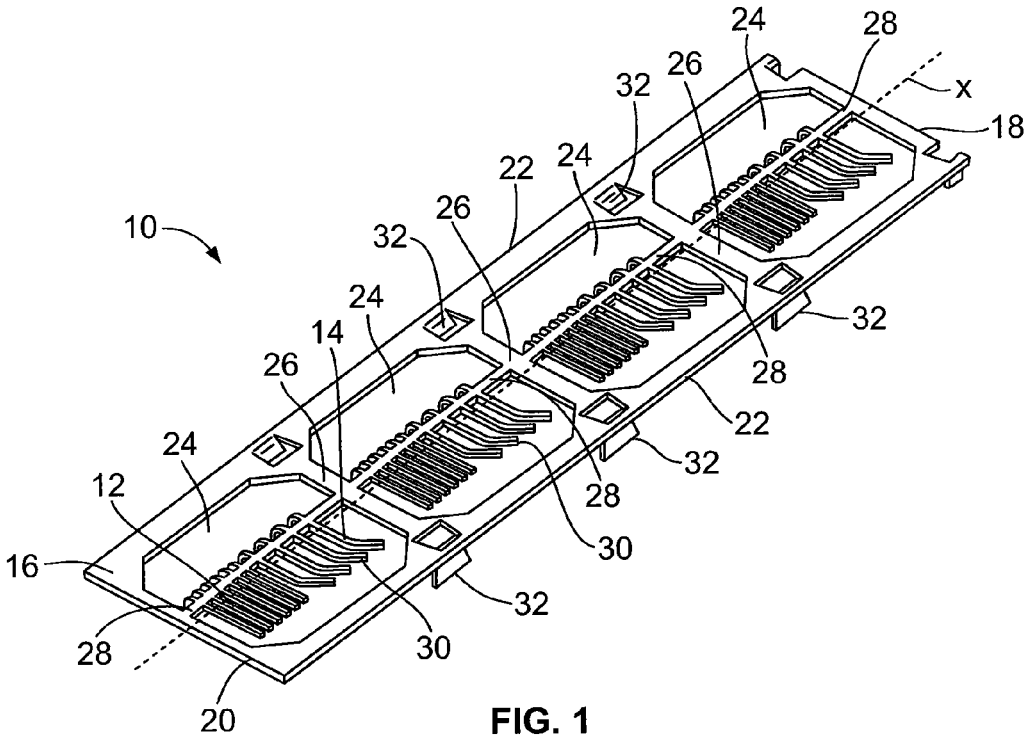
FIG. 1 illustrates a top isometric view of a carrier strip including a plurality of electrical contacts, according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

FIG. 1 illustrates a top isometric view of a carrier strip 10 including a plurality of electrical contacts 12 and 14, according to an embodiment of the present invention. The carrier strip 10 and electrical contacts 12 and 14 are stamped and formed from a single piece of material, such as a conductive metal.

The carrier strip 10 includes a planar base 16 having a leading edge 18 and a trailing edge 20. The leading and trailing edges 18, 20 are connected through integrally formed lateral edges 22. A series of contact cavities 24 are formed through the carrier strip 10 and separated by beams 26 that span between the lateral edges 22.

In each contact cavity 24, a connecting strap 28 spans from the trailing edge 20 or beam 26 to another beam 26 or the leading edge 18. as shown in FIG. 1, the connecting strap 28 may be aligned with and proximate a longitudinal axis X of the carrier strip 10, although the connecting strap 28 may be positioned at various other positions, depending on the size and shape of the electrical contacts 12 and 14.

The electrical contacts 12 and 14 are integrally attached to the connecting straps 28 at regular intervals. The contacts 12 and 14 may be integrally formed and connected to the connecting straps 28 at various points. The contacts 12 and 14 include portions that are out of the plane with respect to the planar base 16, in general, and the connecting straps 28, in particular. For example, the contacts 14 include ends 30 that may be cut or bent out of plane with the planar base 16.

In order to ensure that the portions of the electrical contacts 12 and 14 do not interfere with other contacts 12 and 14 when the carrier strip 10 is spooled around a reel, support tabs 32 are formed in the carrier strip 10 and bent down to support one layer of the carrier strip 10 above another layer of the carrier strip 10. As shown in FIG. 1, each support tab 32 opposes a counterpart support tab 32, both of which are symmetrically aligned about the central axis X. That is, one support tab 32 is a mirror image of another support tab 32, thereby forming a structure that supports the planar base 16 at a uniform height above another surface. As shown in FIG. 1, the support tabs 32 are proximately located to ends of the connecting straps 28. Additional support tabs 32 may be formed at other points along the connecting straps 28. Alternatively, the supports tabs 32 may not be symmetric about the central axis X.

Figure 2:
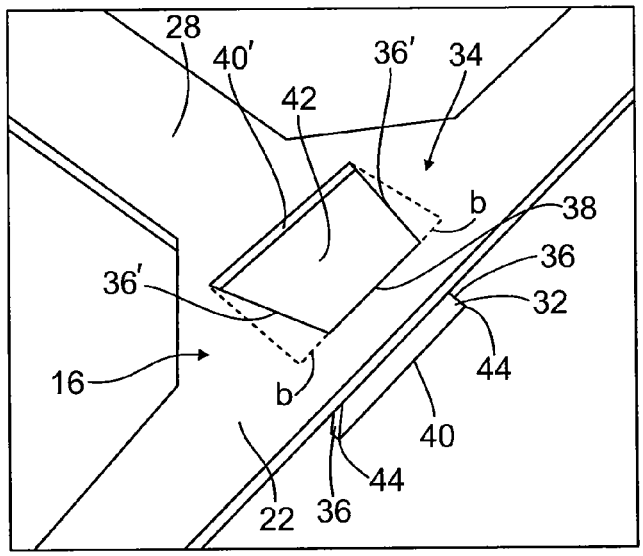
FIG. 2 illustrates a close-up, top isometric view of a tab support surface of a carrier strip, according to an embodiment of the present invention.

FIG. 2 illustrates a close-up, top isometric view of a tab support surface 34 of the carrier strip 10. Each support tab 32 is formed by lancing or cutting three sides of the support tab 32 within the planar base 16. Lateral portions 36 are formed through angled cuts 36' that integrally connect to a stem 38 that remains connected to the planar base 16. The lateral portions 36 and cuts 36' slope away from the stem 38 and connect to an expanded base 40 and expanded cut 40', respectively. As such, the support tabs 32 form trapezoids, with the stem 38 remaining connected to the planar strip 16 and the expanded base 40, which is parallel to the stem 38, being free from the planar strip 16. The support tabs 32 may resemble other shapes, so long as the base 40 is wider than the stem 38.

In order to form the support tabs 32, the angled and expanded cuts 36' and 38' are formed through the planar base 16 such as through a lancing process. Once cut, the expanded base 40 is bent down and away from the planar strip 16, and is pivoted about the stem 38, which remains connected to the planar strip 16. The support tabs 32 are bent into position so that they are perpendicular to the planar strip 16.

Figure 3:
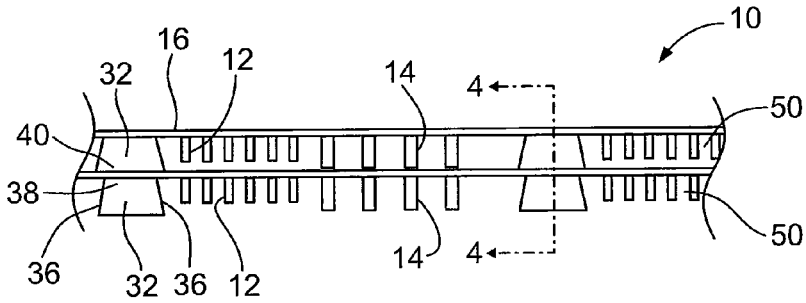
FIG. 3 illustrates a side view of a portion of a spooled carrier strip, according to an embodiment of the present invention.

FIG. 3 illustrates a side view of a portion of a spooled carrier strip 10, according to an embodiment of the present invention. Referring to FIGS. 2-3, when the carrier strip is spooled, the expanded base 40 of each support tab 32 may be aligned over a stem 38 of another support tab 32. Because the expanded base 40 is wider than the stem 38, the expanded base 40 cannot pass through the opening 42 formed through the planar strip 16 from which the support tab 32 was removed. As shown in FIG. 2, the lateral ends 44 of the expanded base 40 are wider than the stem 38 by lengths b. In general, when spooled on a reel, the support tabs 32 may contact any area of the lateral edges 22 over which they are supported. The geometry of the tabs 32 prevents them from slipping into the openings formed in the strip 16.

Figure 4:
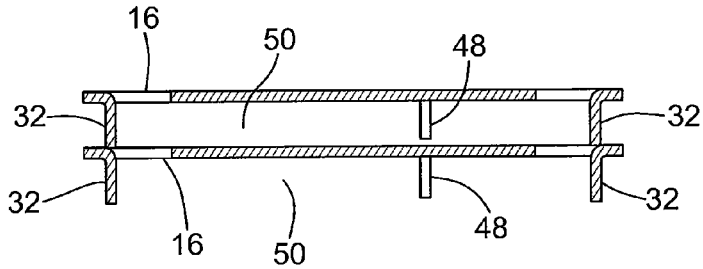
FIG. 4 illustrates a cross-sectional view of a portion of a spooled carrier strip through line 4-4 of FIG. 3, according to an embodiment of the present invention.

FIG. 4 illustrates a cross-sectional view of a portion of the spooled carrier strip 10 through line 4-4 of FIG. 3. A formed contact 48 or another support tab 32 may extend downwardly proximate a junction of a connecting strap 28 and the beam 26. As shown in FIGS. 3 and 4, when the carrier strip 10 is spooled such that one portion is layered over another portion, the support tabs 32 support the planar base 16 over itself, thereby forming a clearance gap 50. The out-of-plane portions (with respect to the planar base 16) of the contacts 12 and 14 reside in the clearance gaps 50. The support tabs 32 prevent the overlapping contacts 12 and 14 from interfering with one another. The support tabs 32 may be sized differently, depending on the size of the electrical contacts 12 and 14. That is, longer support tabs 32 are used to accommodate electrical contacts with portions having increased lengths out-of-plane with the planar strip 16.

Figure 5:
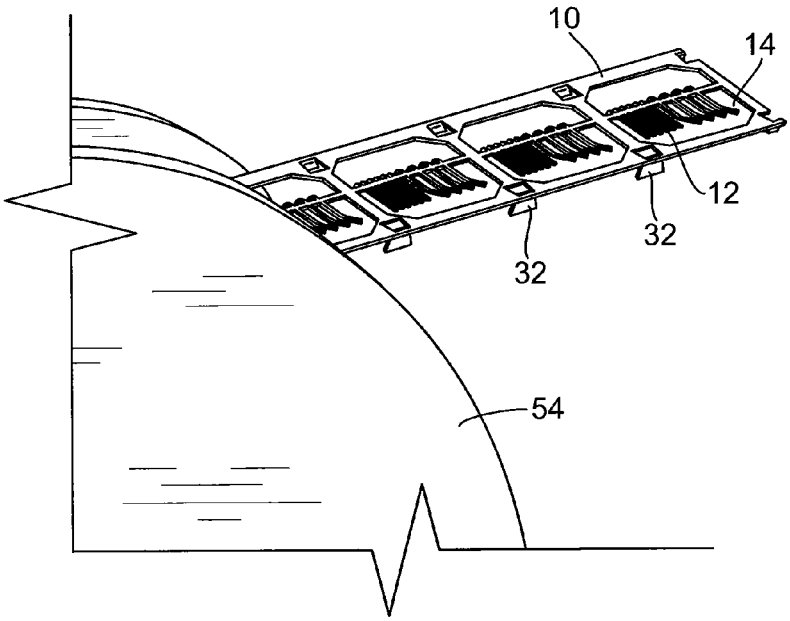
FIG. 5 illustrates an isometric top view of a carrier strip being unspooled from reel, according to an embodiment of the present invention.

FIG. 5 illustrates an isometric top view of the carrier strip 10 being unspooled from reel 54, according to an embodiment of the present invention. Referring to FIGS. 1-5, because the support tabs 32 ensure that contacts 12 and 14 do not interfere with one another, the carrier strip 10 may be spooled around the reel 54 with the assurance that the contacts 12 and 14 will not be damaged by the spooling process.

Figure 6:
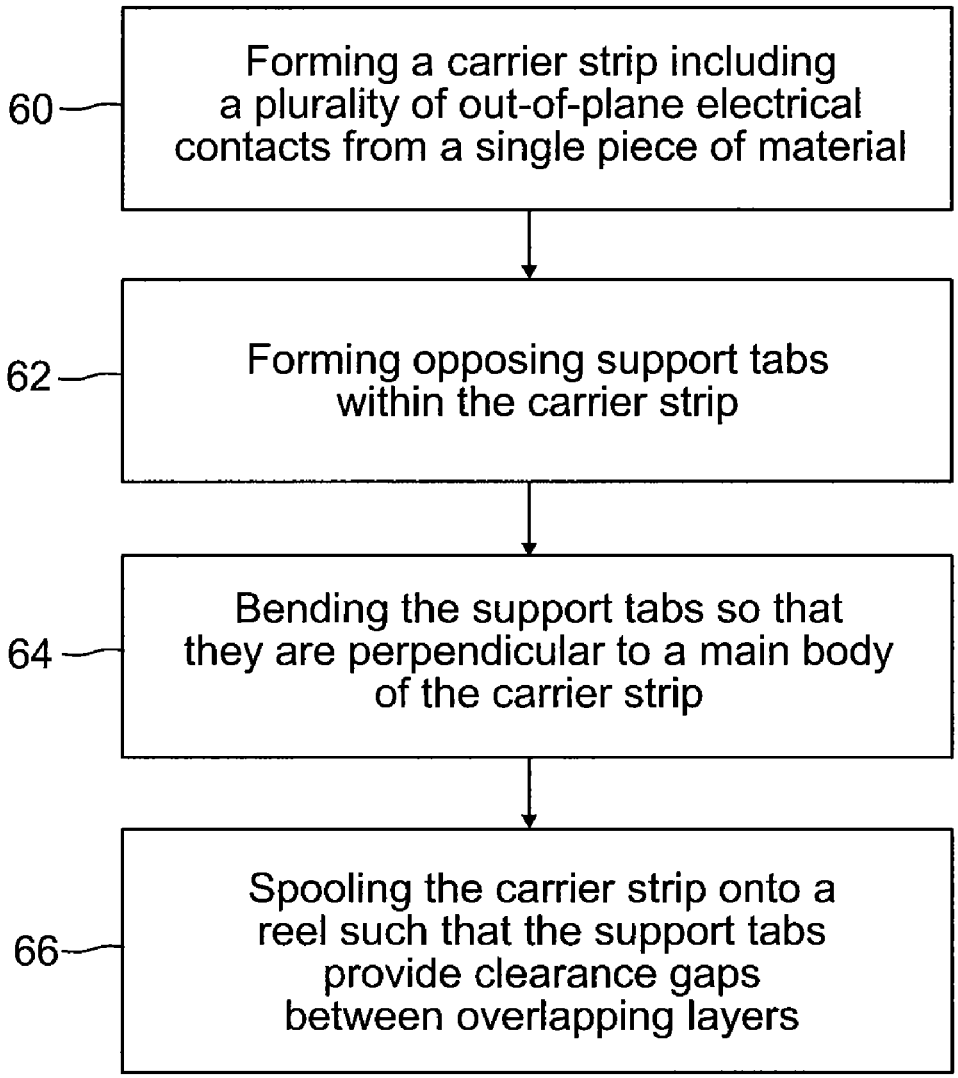
FIG. 6 illustrates a flow chart of a method of forming a carrier strip, according to an embodiment of the present invention.

FIG. 6 illustrates a flow chart of a method of forming a carrier strip, according to an embodiment of the present invention. At 60, a carrier strip including a plurality of out-of-plane electrical contacts is formed from a single piece of material. At 62, opposing support tabs are formed within the carrier strip. The support tabs are then bent so that they are perpendicular to a main body of the carrier strip at 64. The distal free ends of the support tabs are aligned with the smaller stem portions that remain attached to the main body of the carrier strip. At 66, the carrier strip is spooled onto a reel such that the support tabs provide clearance gaps between overlapping layers. The clearance gaps are large enough to ensure that overlapping carrier strips do not interfere with one another.

Thus, embodiments of the present invention provide a system and method of reel-to-reel stamping of formed electrical contacts that allow a manufacturer to take advantage of the plating and handling advantages of a reeled strip of electrical contacts.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. An electrical contact carrier strip comprising:

a main body;

a plurality of electrical contacts integrally formed with and connected to said main body, each of said plurality of electrical contacts comprising at least a portion that is out of plane with respect to said main body; and a plurality of sets of opposed support tabs extending in one direction from said main body, wherein each of said support tabs is perpendicular to said main body, each of said support tabs comprising a stem connected to said main body and a free expanded base that is aligned with and wider than said stem, said plurality of sets of support tabs providing a clearance gap in which said portions of said plurality of electrical contacts that are out of plane with respect to said main body reside, wherein said plurality of sets of support tabs prevent said portions of said plurality of electrical contacts that are out of plane with respect to said main body from intersecting a plane of a surface over which said plurality of sets of support tabs support said main body.

2. The electrical contact carrier strip of claim 1, wherein said main body is spooled around a reel such that a first portion of said main body overlaps a second portion of said main body.

3. The electrical contact carrier strip of claim 2, wherein said plurality of sets of support tabs support said first portion of said main body over said second portion of said main body.

4. The electrical contact carrier strip of claim 1, wherein each of said plurality of sets of support tabs comprises a pair of support tabs that are symmetrically aligned with respect to a longitudinal axis of said main body.

5. The electrical contact carrier strip of claim 1, wherein each of said support tabs is shaped as a trapezoid.

6. The electrical contact carrier strip of claim 1, wherein said main body comprises at least one connecting strap parallel with a longitudinal axis of said main body, wherein each of said plurality of electrical contacts is integrally attached to said at least one connecting strap.

7. The electrical contact carrier strip of claim 1, wherein each of said plurality of support tabs is formed by cuffing three sides within said main body and pivoting said expanded base away from said main body about said stem that remains attached to said main body.

8. An electrical contact carrying system comprising:

a reel;

a main planar body;

a plurality of electrical contacts integrally formed with and connected to said main body, each of said plurality of electrical contacts comprising at least a portion that is out of plane with respect to said main planar body; and a plurality of sets of support tabs extending in one direction from said main planar body, wherein each of said support tabs is perpendicular to said main planar body, each of said support tabs comprising a stem connected to said main planar body and a free expanded base that is aligned with and wider than said stem, said plurality of sets of support tabs providing a clearance gap in which said portions of said plurality of electrical contacts that are out of plane with respect to said main planar body reside, wherein said main planar body is spooled around said reel such that a first portion of said main planar body overlaps a second portion of said main planar body, said plurality of sets of support tabs supporting said first portion of said main planar body over said second portion of said main planar body, wherein said plurality of sets of support tabs prevent said portions of said plurality of electrical contacts that are out of plane with respect to said main planar body from intersecting a plane of a surface over which said plurality of sets of support tabs support said main planar body.

9. The system of claim 8, wherein each of said plurality of sets of support tabs comprises a pair of support tabs that are symmetrically aligned with respect to a longitudinal axis of said main planar body.

10. The system of claim 9, wherein each of said support tabs is shaped as a trapezoid.

11. The system of claim 10, wherein said main planar body comprises at least one connecting strap parallel with a longitudinal axis of said main planar body, wherein each of said plurality of electrical contacts is integrally attached to said at least one connecting strap.

12. The system of claim 8, wherein each of said plurality of support tabs is formed by cutting three sides within said main planar body and pivoting said expanded base away from said main planar body about said stem that remains attached to said main planar body.

13. An electrical contact carrier strip comprising:

a main body;

a plurality of electrical contacts integrally formed with and connected to said main body; and a plurality of support tabs extending in one direction from said main body, each of said support tabs comprising a stem connected to said main body and a free expanded base that is aligned with and wider than said stem, said support tabs providing a clearance gap in which at least portions of said plurality of electrical contacts reside, wherein said plurality of support tabs support said at least portions of said plurality of electrical contacts over a plane in which distal ends of each of said free expanded bases of said support tabs reside.

14. The electrical contact carrier strip of claim 13, wherein each of said support tabs is perpendicular to said main body.

15. The electrical contact carrier strip of claim 13, wherein said main body is spooled around a reel such that a first portion of said main body overlaps a second portion of said main body.

16. The electrical contact carrier strip of claim 15, wherein said plurality of support tabs support said first portion of said main body over said second portion of said main body.

17. The electrical contact carrier strip of claim 13, wherein said plurality of support tabs comprise a pair of support tabs that are symmetrically aligned with respect to a longitudinal axis of said main body.

18. The electrical contact carrier strip of claim 13, wherein each of said plurality of support tabs is shaped as a trapezoid.

19. The electrical contact carrier strip of claim 13, wherein said main body comprises at least one connecting strap parallel with a longitudinal axis of said main body, wherein each of said plurality of electrical contacts is integrally attached to said at least one connecting strap.

20. The electrical contact carrier strip of claim 13, wherein each of said plurality of support tabs is formed by cutting three sides within said main body and pivoting said expanded base away from said main body about said stem that remains attached to said main body.

* * * * *